United States Patent [19]

Degen et al.

[11] 4,383,834

[45] May 17, 1983

[54] COLORING OF PAPER

[75] Inventors: Hans-Juergen Degen, Lorsch; Wolf Guender, Neustadt; Guenter Frey, Dannstadt-Schauernheim; Werner Streit, Bobenheim; Rolf Fikentscher, Ludwigshafen; Klaus Wulz, Lambsheim, all of Fed. Rep. of Germany

[73] Assignee: BASF Aktiengesellschaft, Ludwigshafen, Fed. Rep. of Germany

[21] Appl. No.: 350,143

[22] Filed: Feb. 19, 1982

[30] Foreign Application Priority Data

Mar. 25, 1981 [DE] Fed. Rep. of Germany ..... 3111712

[51] Int. Cl.[3] ..... D21D 3/00; D06P 1/46; D21H 3/80; D21H 3/82

[52] U.S. Cl. ..... 8/551; 8/554; 8/919; 162/162

[58] Field of Search ..... 8/551, 554, 919; 162/162

[56] References Cited

U.S. PATENT DOCUMENTS

| | | | |
|---|---|---|---|
| 3,049,468 | 8/1962 | Hinton et al. | 162/162 |
| 3,926,553 | 12/1975 | Fuest | 8/554 |
| 4,243,390 | 1/1981 | Schafer et al. | 8/554 |

FOREIGN PATENT DOCUMENTS

| | | | |
|---|---|---|---|
| 2458443 | 7/1975 | Fed. Rep. of Germany | 162/162 |

*Primary Examiner*—Maria Parrish Tungol
*Attorney, Agent, or Firm*—Oblon, Fisher, Spivak, McClelland & Maier

[57] ABSTRACT

A process for coloring paper with an acid dye and/or direct dye in an aqueous medium in the presence of a water-soluble reaction product of an alkylating agent, possessing an aromatic substituent, with a cationic polyelectrolyte.

The process gives papers with high color strength and substantially avoids cylinder twosidedness of the coloration.

6 Claims, No Drawings

COLORING OF PAPER

German Laid-Open Application DOS No. 2,458,443 discloses a process for the preparation of colored paper in which the dye used is a reactive dye and the assistant used is a polyalkyleneimine, which may or may not be quaternized. Coloring can be effected either at the wet end or after formation of the paper sheet.

In order to diminish or eliminate the color two-sidedness of filled papers which have been pulp-colored with cationic dyes, German Laid-Open Application DOS No. 2,012,217 proposes effecting the coloration in presence of a cationic polymeric compound, and adding the cationic dye to the pulp only after the said polymeric compound has been added. However, the conventional paper-coloring assistants are insufficiently effective when used in conjunction with acid dyes or direct dyes.

It is an object of the present invention to provide, for a process for coloring paper with acid dyes and/or direct dyes in an aqueous medium, an effective assistant allows papers with high color strength to be obtained, whilst substantially avoiding the cylinder twosidedness of the coloration.

We have found that this object is achieved, according to the invention, by using, as the cationic assistant, a water-soluble reaction product of an alkylating agent, possessing an aromatic substituent, with a cationic polyelectrolyte. Particularly effective assistants for the process according to the invention are obtained by modifying the above reaction product, in a second stage, by reacting it with cyanamide and/or dicyandiamide.

Suitable dyes for the process according to the invention are acid dyes, direct dyes and mixtures of both categories of dyes. Dyes of these categories may be found in the Color Index. For instance, acid dyes are given on pages 1003–1560 of the Color Index, Volume 1, 3rd edition, The Society of Dyers and Colorists and American Association of Textile Chemists and Colorists. Some typical examples of acid dyes which are particularly suitable for coloring paper are the yellow acid dyes C.I. 13,065 and 47,035, the orange dyes C.I. 13,090, C.I. 15,575 and C.I. 15,510 and the red acid dyes C.I. 45,380 and C.I. 15,620. Direct dyes are given on pages 2007–2477 of the Color Index, Volume 2. Typical direct dyes usually employed to color paper are the yellow direct dyes C.I. 29,000, C.I. 24,895, C.I. 13,950, C.I. 29,025, C.I. 40,000, C.I. 40,001 and C.I. 24,890, the orange direct dyes C.I. 40,215, C.I. 40,265 and C.I. 29,156, the red direct dyes C.I. 29,175, C.I. 28,160, C.I. 22,120 and C.I. 25,410, the blue direct dyes C.I. 23,155 and C.I. 24,340 and the violet direct dye C.I. 25,410.

The cationic assistants used for the process according to the invention are water-soluble and are prepared by reaction of an alkylating agent, possessing an aromatic substituent, with a cationic polyelectrolyte. Examples of suitable alkylating agents are benzyl halides, eg. benzyl chloride, benzyl bromide and benzyl iodide, styrene oxide, chloromethylbiphenyls and bischloromethylbiphenyls, eg. 4-chloromethylbiphenyl and 4,4'-bischloromethylbiphenyl, and $\alpha$- and $\beta$-halomethylnaphthalenes, eg. $\alpha$-chloromethylnaphthalene, $\beta$-chloromethylnaphtahalene, $\alpha$-bromomethylnaphthalene and $\beta$-bromomethylnaphthalene. In addition to the groups mentioned, the aromatic substituents of the alkylating agents may carry other substituents, for example $C_1$–$C_{12}$-alkyl, chlorine, bromine, phenyl, p-chloromethylphenyl, hydroxymethyl and chloromethyl. The preferred alkylating agent is benzyl chloride.

In principle, any cationic polyelectrolyte can serve as the second component for the preparation of the cationic assistant. Preferably, the cationic polyelectrolyte used contains aminoalkyl groups. Examples of suitable cationic polyelectrolytes include polyethyleneimines which possess not less than 5 aminoalkyl groups, polyvinylamines and crosslinking products of ammonia or amines, especially of diamines or oligoamines, with 1,2-dichloroethane, epichlorohydrin, dichlorohydrin ether or chlorohydrin ethers of dihydric or polyhydric alcohols. Dichlorohydrin ether is obtained by, for example, reacting 2 moles of epichlorohydrin with one mole of water. Chlorohydrin ethers of dihydric or polyhydric alcohols are derived from glycols or polyols which have molecular weights of at most 300 and which are obtained by reaction of from 1 to 1.5 moles of epichlorohydrin per mole of OH groups in the polyhydric alcohol or polyglycol, using an acid catalyst (eg. $H_2SO_4$ or $BF_3$). Examples of suitable diamines or oligoamines are ethylenediamine, propylenediamine, diethylenetriamine, dipropylenetriamine, triethylenetetramine, bis-aminopropyl-ethylenediamine, tetraethylenepentamine, piperazine, aminoethylpiperazine, aminopropylpiperazine, diaminoethylpiperazine and diaminopropylpiperazine. The viscosity of the crosslinked products obtained with ammonia and the diamines or oligoamines is at most 40,000 mPa.s in 40% strength aqueous solution.

Polyvinylamines are prepared by, for example,subjecting vinylformamide to free radical polymerization and hydrolyzing the polymer in an acid medium.

Other suitable cationic polyelectrolytes are condensates, containing carboxamide groups, onto which alkyleneimine units have been grafted. This category of substances in particular includes polyamidoamines which are obtained by reacting dicarboxylic acids of 4 to 10 carbon atoms with polyalkylenepolyamines having from 3 to 10 basic nitrogen atoms in the molecule. Examples of suitable dicarboxylic acids are succinic acid, maleic acid, adipic acid, glutaric acid, suberic acid, sebacic acid and terephthalic acid. Mixtures of dicarboxylic acids, eg. of adipic acid and glutaric acid, or of maleic acid and adipic acid, may also be used to prepare the polyamides. Use of adipic acid alone is preferred. The carboxylic acids are condensed with polyalkylenepolyamines which contain from 3 to 10 basic nitrogen atoms in the molecule, eg. diethylenetriamine, triethylenetetramine, tetraethylenepentamine, dipropylenetriamine, tripropylenetetramine or dihexamethylenetriamine, or with mixtures of these compounds. The amines may contain up to 10% by weight of a diamine, eg. ethylenediamine or hexamethylenediamine. The condensation of the dicarboxylic acids with the polyalkylenepolyamines is preferably carried out undiluted, but can also be carried out in a solvent which is inert to the reactants. The condensation is carried out at from 80° to 200° C., and the water formed in the reaction is distilled from the system. The condensation can also be carried out in the presence of lactones or lactams of carboxylic acids of 5 to 12 carbon atoms, in which case these products are incorporated as condensed units into the polyamidoamine. From 0.8 to 1.4 moles of polyalkylenepolyamine are used per mole of dicarboxylic acid.

Condensates containing carboxamide groups are also obtained by reacting acrylic esters or methacrylic esters with diamines, eg. ethylenediamine or hexamethylenediamine, or with oligoamines. A further possible method of synthesis is to react urea with bis-aminoethylmethylamine.

The above water-soluble condensates containing carboxamide groups are subjected to cationic modification by introducing alkyleneimine units. This is done most simply by, for example, grafting alkyleneimines, especially ethyleneimine, onto the condensates in the presence of a Lewis acid, eg. boron trifluoride etherate, or of sulfuric acid. The grafting reaction is carried out with from 20 to 400, preferably from 50 to 300, parts by weight of ethyleneimine per 100 parts by weight of a condensate containing carboxamide groups. Products of this type are disclosed in, for example, German Published Application DAS No. 2,434,816.

Alkyleneimine groups can also be formed by reacing a mono-(aminoalkyl) sulfate with the condensate, containing carboxamide groups, at an alkaline pH. For example, the condensates containing carboxamide groups can be aminoethylated by reaction with mono-($\beta$-aminoethyl) sulfate.

The cationic polyelectrolyte is reacted either completely or only partially with the alkylating agent possessing an aromatic substituent; however, not less than 10% of the aminoalkyl groups of the cationic polyelectrolyte should be reacted with the alkylating agent. Specifically in the case of a reaction product of a piperazine and epichlorohydrin, partial quaternization of the cationic polyelectrolyte should preferably result in from 30 to 60% of quaternary nitrogen atoms.

Particularly effective assistants are obtained by modifying the reaction products of alkylating agents, possessing an aromatic substituent, and cationic polyelectrolytes, in a second stage, with cyanamide or dicyandiamide or a mixture of cyanamide and dicyandiamide. From 1 to 100, preferably from 5 to 20, parts by weight of cyanamide and/or dicyandiamide are used per 100 parts by weight of partially alkylated cationic polyelectrolyte. The reaction is carried out in aqueous solution at from 70° to 100° C.

In the process according to the invention, paper is colored in the presence of one of the cationic assistants described above. Preferably, wet-end coloring, ie. coloring during manufacture of the paper, is employed. For this purpose, an acid dye, direct dye or mixture of dyes of both categories is added, together with the cationic assistant, to the pulp, and the latter is then drained in a conventional manner on a papermaking machine. The colored paper is thus obtained direct. This step can also be combined with paper sizing by adding an engine-sizing agent to the pulp. The sequence of addition of the dyes and cationic assistant to the pulp is not a critical factor in the quality of coloration obtained. A mixture of the dyes in question and the cationic assistant can be added to the paper pulp, or the dyes can first be added to the pulp, followed by the cationic assistant, or the assistant can be added first, followed by the dyes. Wet-end coloring of paper in general requires from 0.1 to 10% of dye, based on the weight of dry paper fibers. The amount of cationic assistant used is from 10 to 300% by weight, preferably from 30 to 150% by weight, based on dye. The coloring process can be carried out over a wide temperature range, for example at from room temperature to about 60° C., preferably from 20° to 50° C.

The paper can however also be colored, according to the invention, after sheet formation, by applying the cationic assistant and one or more of the appropriate dyes successively to the surface of the paper, for example by spraying the paper with the assistant and then applying the dye in a sizing press. It is also possible first to treat the paper with the cationic assistant by introducing the latter into the pulp, and then to apply an aqueous solution of the dyes to the paper in the sizing press. Alternatively, the dye can be added to the pulp, and the cationic assistant applied in the sizing press. The important feature is, in every case,that coloring is effected in combination with the cationic assistant.

When drying paper which has been colored with acid dyes, it is often found in practice that the color is different on the two sides (an effect referred to as cylinder twosidedness). This means that the top face and bottom face of the colored paper produced, differ in color strength or in hue, or in both. This color twosidedness is as a rule regarded as a substantial lowering of quality. Using the process according to the invention, deep and virtually identical colorations are obtained on the top face and bottom face of the paper formed. A further advantage of the novel process over conventional processes is that, especially with acid dyes, substantially better dye retention is achieved. The papermaking machine waste water contains at most about half as much unutilized dye as waste water from papermaking machines operated with coloring processes employing conventional assistants. Finally, papers colored according to the invention show very little bleeding in contact with other materials, for example other papers, foodstuffs or textiles, in the presence of a wetting fluid, eg. water, milk, aqueous alcohol or soap liquor.

The invention is explained in more detail below. In the Examples, parts and percentages are by weight. The cylinder twosidedness was assessed by the following laboratory method:

Colored paper sheets were produced on a laboratory sheet-forming apparatus, and before drying the moist colored sheet on a felt-covered cylinder at 90° C., a water vapor-impermeable plastic disc was placed on the felt side of the moist paper sheet. During drying, the plastic disc acted as a barrier to the water vapor, so that the latter had to evaporate from the sides. Since the cylinder twosidedness results from migration of the dye with the water vapor escaping from the paper sheet, the phenomenon is particularly easily observed with the experimental arrangement described above. If the coloration exhibits cylinder twosidedness, the paper under the plastic disc shows partial or complete depletion of dye. The twosidedness was assessed by comparing the color strength under the area covered by the plastic disc with the color strength of the remainder of the paper sheet.

| Assessment of cylinder twosidedness | Reduction of color strength, relative to surface not covered with plastic disc |
|---|---|
| very marked | 50–100% |
| marked | 30–50% |
| distinctly noticeable | 15–30% |
| noticeable | 5–15% |
| none | 0–5% |

Applying the assessment "none" to a loss of color strength of from 0 to 5% corresponds to the fact that differences in the color strength of this order of magnitude are very difficult to perceive with the human eye and are therefore immaterial in practice.

PREPARATION OF THE CATIONIC ASSISTANTS

Assistant 1

259 g of a 49.9% strength aqueous solution of a polyethyleneimine of molecular weight 1,500 were introduced in a 1 liter four-necked flask equipped with a stirrer, reflux condenser, thermometer and dropping funnel, and were heated to 80°–85° C. The heating bath was then removed and 114 g of benzyl chloride were added dropwise in the course of 30 minutes, during which the temperature of the reaction mixture rose to 92° C. A solution of 38 g of cyanamide in 38 g of water was then added as a single shot, after which the reaction mixture was kept at 90° C. for 5 hours. It was then allowed to cool and 101 g of distilled water were added. 562 g of an aqueous solution of a partially benzylated cyanamide-modified polyethyleneimine, having a solids content of 51.1%, were obtained.

Assistant 2

259 g of a 49.9% strength aqueous solution of a polyethyleneimine of molecular weight 1,500 were introduced into a 1 liter four-necked flask equipped with a stirrer, reflux condenser, thermometer and dropping funnel, and were heated to 85° C. 114 g of benzyl chloride were then added dropwise in the course of 30 minutes, during which the temperature rose to 93° C. After completion of the addition, the reaction solution was heated for ½ hour at 90° C. and diluted with 113 g of distilled water. 486 g of a 50.3% strength aqueous solution of a partially benzylated polyethyleneimine were obtained.

Assistant 3

128 g of technical-grade piperazine and 65 ml of distilled water were introduced into a 1 liter four-necked flask equipped with a stirrer, reflux condenser, thermometer and dropping funnel and were heated to 80° C. 88 g of epichlorohydrin were then added dropwise in the course of one hour, whilst cooling the flask in an icebath, and the temperature was then kept at 80° C. by cooling. The condensation took 3–4 hours and an aqueous solution having a viscosity of 4,500 mPa.s were obtained.

183 g of distilled water and 80 g of 50% strength aqueous sodium hydroxide solution were then added, after which 126 g of benzyl chloride were introduced dropwise in the course of 1 hour at 70° C., and the reaction mixture was then stirred for 2 hours at 80° C. The solution was cooled to 30° C. and 133 g of distilled water and 200 g of 100% strength formic acid were added, whilst stirring. 999 g of a 20% strength aqueous solution of a piperazine resin having a viscosity of 33 mPa.s were obtained. The chloride content was 1.45 milliequivalent/g and the pH was 1.8.

Assistant 4

A polyamidoamine was first prepared by mixing 1,044 parts of water and 2,150 parts of diethylenetriamine under nitrogen at room temperature and adding 2,800 parts of adipic acid, with cooling. The reaction mixture was then heated so that the water originally added as well as the water formed during the condensation distilled off. Continuous distillation of the water for 5 hours resulted in a temperature of 170° C. in the distillation vessel. This temperature was maintained until the resin had an acid number of less than 10; this was reached after about 10 hours. The resin was cooled and, when the temperature had reached 130° C., 3,100 parts of water were added. An aqueous solution of 61.4% solids content was obtained.

The polyamidoamine thus obtained was grafted with ethyleneimine. To do so, 326 parts of the 61.4% strength resin were mixed with 4.5 parts of concentrated sulfuric acid in 70 parts of water and the mixture was heated to 80° C. 200 parts of a 50% strength aqueous ethyleneimine solution were then run in over 5 hours, with thorough mixing, after which the reaction mixture was kept at 80°–90° C. for a further 2–3 hours. The reaction can be regarded as complete only when ethyleneimine is no longer detectable with p-nitrobenzylpyridine. A 50.8% strength aqueous solution of an ethyleneimine-grafted polyamidoamine was obtained.

This product was benzylated by mixing 192 parts of the 50.8% strength aqueous resin solution with 311 parts of water, heating the mixture to 80° C. and combining it, in the course of half an hour, with 76 parts of benzyl chloride at 80°–90° C. After completion of addition of the benzyl chloride, the reaction solution was heated at 90° C. for a further hour and then cooled. A 30.1% strength aqueous solution of a benzylated ethyleneimine-grafted polyamidoamine was obtained.

Assistant 5

256 g of a 50.45 strength aqueous solution of a polyethyleneimine of molecular weight 430 were introduced into a 1 liter four-necked flask, equipped with a stirrer, reflux condenser, thermometer and dropping funnel, and were heated to 85° C. After removing the heating bath, 114 g of benzyl chloride were added dropwise to the charge, resulting in a temperature rise to 93° C. After completion of the addition, the reaction mixture was stirred for a further half hour at 90° C. and then diluted with 116 g of distilled water and cooled. 485 g of a partially benzylated polyethyleneimine, having a solids content of 50.1%, were obtained.

Assistant 6

Following the method described for Assistant 5, 259 g of a 49.9% strength aqueous solution of a polyethyleneimine of molecular weight 1,500 were quaternized with 228 g of benzyl chloride. After completion of the quaternization reaction, 227 g of distilled water were added to the reaction mixture and 713 g of a partially benzylated polyethyleneimine of 49.6% solids content were obtained.

Assistant 7

151 g of a 52.1% strength aqueous solution of polyethyleneimine of molecular weight 258 were introduced into a 1 liter four-necked flask equipped with a stirrer, reflux condenser, thermometer and dropping funnel and were heated to 90° C. The heating bath was then removed and 84 g of benzyl chloride were added to the reaction mixture in the course of 20 minutes, during which the temperature remained at 90° C. because of the exothermic reaction. After addition of the benzyl chloride, the reaction solution was heated for half an hour at 90° C., a solution of 21 g of cyanamide in 21 g of distilled water were then added as a single shot, and the mixture was stirred for 5 hours at 90° C. Thereafter, the aqueous solution was diluted with 89 g of distilled water and 366 g of a 50% strength aqueous solution of a polyethyleneimine modified with benzyl chloride and cyanamide was obtained.

Assistant 8

507 g of a 42.4% strength aqueous solution of a polyethyleneimine of molecular weight 860 were introduced into a 2 liter four-necked flask equipped with a stirrer, reflux condenser, thermometer and dropping funnel, and were heated to 90° C. 300 g of styrene oxide were then added in the course of 3 hours, with thorough mixing. Thereafter, the reaction solution was heated for a further hour at 90° C., cooled and mixed with 223 g of distilled water. 1,028 g of a 50.2% strength aqueous solution of a styrene oxide-modified polyethyleneimine were obtained.

Assistant 9 (prior art)

267 g of a 48.3% strength polyethyleneimine of molecular weight 860 were heated to 85° C. in a 1 liter four-necked flask equipped with a stirrer, reflux condenser, thermometer and gas inlet tube. 53 g of ethylene oxide were then passed into the solution in the course of 4 hours, at 85° C., after which the mixture was stirred for a further hour at the same temperature. The solution was then diluted with 44 g of distilled water. 364 g of a 50% strength aqueous solution of a polyethyleneimine partially modified with ethylene oxide were obtained.

Assistant 10 (prior art)

259 g of a 49.9% strength aqueous solution of a polyethyleneimine of molecular weight 1,500 were introduced into a 1 liter four-necked flask equipped with a stirrer, reflux condenser, thermometer and dropping funnel, and were heated to 30° C. When this temperature had been reached, 378 g of dimethyl sulfate were added dropwise, in the course of 2 hours, at a rate such that the temperature did not rise above 50° C. Thereafter, the reaction mixture was stirred for a further hour at 50° C. and then heated for half an hour at 80° C. 630 g of an aqueous solution of a dimethyl sulfate-modified polyethyleneimine were obtained.

Assistant 11 (prior art)

202 g of a 49.9% strength aqueous solution of a polyethyleneimine of molecular weight 1,500 were introduced into a 2 liter four-necked flask equipped with a stirrer, reflux condenser, thermometer and dropping funnel and were heated to 45° C., with stirring. 266 g of dimethyl sulfate were added dropwise in the course of 2 hours, with stirring, and in part with cooling, under conditions such that the reaction temperature was 45°-50° C. The mixture was then neutralized by dropwise addition of 174 g of 48.5% strength aqueous sodium hydroxide solution. The resulting mixture was heated to 90° C. and 324 g of dimethyl sulfate were added dropwise, with stirring and cooling, under the same conditions as described above so that the temperature remained at 90° C. The excess dimethyl sulfate was neutralized with 19 g of 48.5% strength aqueous sodium hydroxide solution and the mixture was then heated for a further 3 hours at 90° C. 984 g of an aqueous solution of a dimethyl sulfate-quaternized polyethyleneimine were obtained.

Assistant 12

623 g of aminoethylpiperazine and 718 g of distilled water were introduced into a 4 liter four-necked flask equipped with a stirrer, reflux condenser, thermometer and dropping funnel, and were heated to 80° C. At this temperature, 444 g of epichlorohydrin were added dropwise in the course of 3 hours, with cooling, and the reaction temperature was then kept for 4 hours at 80°-85° C., after which the chloride content was 2.68 milliequivalents/g.

201 g of distilled water and 80 g of 50% strength aqueous sodium hydroxide solution were added to 369 g of the aminoalkylpiperazine/epichlorohydrin resin (containing 43.9% of active ingredient). 126 g of benzyl chloride were then added dropwise in the course of 1 hour, at 80° C., and the reaction mixture was subsequently stirred for 2 hours at 90° C. The chloride content was 2.77 milliequivalents/g. 437 g of distilled water and 420 g of 100% strength formic acid were added to the reaction solution, which then had a pH of 2.66 and contained 20% of active ingredient.

Assistant 13

349 g of N,N'-bis-(3-aminopropyl)-ethylenediamine and 497 g of distilled water were introduced into a 2 liter four-necked flask equipped with a stirrer, reflux condenser, thermometer and dropping funnel, and were heated to 80° C. 148 g of epichlorohydrin were added dropwise in the course of one hour and the reaction temperature was kept at from 80° to 85° C. by cooling the flask. The chloride content of the resulting solution was 1.66 milliequivalents/g. 508 g of benzyl chloride were then added dropwise to the solution over one hour at 80° C., with cooling, and the reaction was then allowed to continue for 2 hours at 80° C. 1,502 g of an aqueous resin solution, containing 66.7% of active ingredient, were obtained. The chloride content was 3.77 milliequivalents/g.

Assistant 14

750 g of the 66.7% strength Assistant 13 were reacted with a solution of 50 g of cyanamide in 50 g of distilled water in a 1 liter four-necked flask at 90° C. The reaction was complete after 5 hours at 90° C. 218 g of distilled water were then added and 1,068 g of a 49.9% strength aqueous solution of a cyanamide-modified benzylated amine-epichlorhydrin resin were obtained.

Assistant 15

378 g of tetraetylenepentamine and 581 g of distilled water were introduced into a 2 liter four-necked flask equipped with a stirrer, reflux condenser, thermometer and dropping funnel, and were heated to 80° C. 203 g of dichlorohydrin ether were added dropwise in the course of half an hour at this temperature, with cooling, and the batch was then allowed to react for a further 13 hours at 80° C. The chloride content of the solution obtained was 1.76 milliequivalents/g. 630 g of benzyl chloride were added dropwise to the solution in the course of 1 hour, with cooling, and the reaction temperature was then kept at 80° C. for 6 hours. After completion of the reaction, the chloride content was 3.92 milliequivalents/g. 1,790 g of a 66.1% strength aqueous solution of the cationic Assistant 15 were obtained.

Assistant 16

896 g of the cationic Assistant 15 were heated to 90° C. in a 2 liter four-necked flask equipped with a stirrer, reflux condenser, thermometer and dropping funnel, and a solution of 63 g of cyanamide in 63 g of distilled water were added as a single shot. The reaction mixture was heated at 90° C. for 5 hours, after which 327 g of distilled water were added. 1,349 of a 50% strength aqueous solution of a cationic assistant were obtained.

EXAMPLE 1

70 g of bleached sulfate cellulose (pine) and 30 g of bleached sulfite cellulose (beech), each with a freeness of 35° SR, were battered to give an 0.5% strength pulp suspension. 1.0 g of the acid orange dye C.I. 15,510, in the form of a 1% strength aqueous solution, were added to this suspension. After having homogenized the dye in the suspension, after 10 minutes 0.33 g of Assistant 1 was added and the suspension was stirrred for a further 10 minutes. Sheets weighing 80 g/m$^2$ were produced from this suspension on a laboratory sheet-forming apparatus (from Frank), and samples of the drainage water were taken. The fibers and fines were centrifuged out of this water, which was then examined for its dye content. It was found to contain 14% of the dye initially employed.

To determine the cylinder twosidedness of the colored paper, the moist paper was dried, without turning it, between two absorbent papers on a felt-covered cylinder, at 90° C., for 10 minutes; however, before drying, a plastic disc of 5 cm diameter was placed on the side of the moist paper which faced the felt. The paper sheets exhibited an even coloration, with no cylinder twosidedness.

COMPARATIVE EXAMPLE 1

Example 1 was repeated except that the cationic assistant was omitted. The drainage water is found to contain 95% of the dye employed. The coloration of the paper is very pale and uneven, with very marked cylinder twosidedness.

COMPARATIVE EXAMPLE 2

Example 1 was repeated, except that in place of Assistant 1, a polyethyleneimine of molecular weight 1,500, which had not been reacted with benzyl chloride, was employed. The drainage water contained 32% of the dye employed. The paper showed an even coloration, but with distinctly noticeable twosidedness.

EXAMPLE 2

100 g of groundwood (pine) of freeness (50° SR were battered to form an 0.5% strength aqueous stuff suspension, to which 1 g of the acid oragne dye C.I. 15,510 was added in the form of a 1% strength aqeuous solution. 0.33 g of Assistant 1 were then added, as were—in order to size the paper—0.6%, based on dry fiber weight, of resin size and 3% of alum. Paper sheets weighing 80 g/m$^2$ were then produced on a laboratory sheet-forming apparatus. The drainage water contained 6% of the dye employed. The coloration of the paper sheets was even, with no cylinder twosidedness.

COMPARATIVE EXAMPLE 3

Example 2 was repeated except that Assistant 1 was omitted. The drainage water contained 53% of the dye employed. The coloration produced was even, but with noticeable cylinder twosidedness.

EXAMPLE 3

70 g of bleached sulfate cellulose (pine) and 30 g of bleached sulfite cellulose (beech), each with a freeness of 35° SR, were battered to give an 0.5% strength stuff suspension. 1 g of the red direct dye C.I. 28,160, in the form of a 1% strength aqueous solution, were added to this suspension. After homogenizing the dye in the dispersion, 0.7 g of Assistant 1 was added. The suspension was then stirred for a further 10 minutes and converted to paper sheets on a laboratory sheet-forming apparatus, as described in Example 1. The drainage water contained 3% of the dye employed. Testing the fastness of the dyed paper to bleeding, by the method of DIN 53,991, page 1, gave the following values:

| | |
|---|---|
| distilled water | 4–5 |
| 1.5% strength acetic acid | 4 |
| 0.5% strength sodium carbonate solution | 3–4 |

COMPARATIVE EXAMPLE 4

Example 3 was repeated, but in the absence of Assistant 1. The drainage water contained 18% of the dye employed. Determination of the fastness to bleeding, by the method of DIN 53,991, page 1, gave the following values:

| | |
|---|---|
| distilled water | 2 |
| 1.5% strength acetic acid | 2 |
| 0.5% strength sodium carbonate solution | 1 |

EXAMPLE 4

70 g of bleached sulfate cellulose (pine) and 30 g of bleached sulfite cellulose (beech), each with a freeness of 35° SR, were battered to give an 0.5% strength stuff suspension. 0.33 g of Assistant 1 were added to the suspension, which was then homogenized for 10 minutes. 1.0 g of the orange acid dye C.I. 15,510 was then added in the form of a 1% strength aqueous solution, and the mixture was homogenized for 10 minutes. Paper sheets were then produced on a laboratory sheet-forming apparatus. The fastness of the sheets was substantially the same as in Example 1, but the coloration was about 15% deeper. The drainage water contained less than 14% of the dye employed.

EXAMPLE 5

Example 1 was repeated several times, but using, in place of 0.33 g of Assistant 1, the amounts of Assistant 1 shown in Table 1, as well as the other assistants shown in Table 1, in the amounts also indicated there. The final column of Table 1 shows the dye content in the drainage water, as a percentage based on the dye employed.

TABLE 1

| Assistant No. | % of assistant, based on dye employed | % of dye in the drainage water |
|---|---|---|
| 1 | 25 | 40 |
| 1 | 50 | 16 |
| 1 | 100 | 11 |
| 1 | 175 | 6 |
| 2 | 25 | 38 |
| 2 | 50 | 23 |
| 2 | 100 | 10 |
| 2 | 175 | 4 |
| 3 | 25 | 39 |
| 3 | 50 | 15 |
| 3 | 100 | 6 |
| 3 | 175 | 4 |
| 4 | 25 | 45 |
| 4 | 50 | 21 |
| 4 | 100 | 11 |
| 4 | 175 | 5 |

TABLE 1-continued

| Assistant No. | % of assistant, based on dye employed | % of dye in the drainage water |
|---|---|---|
| 5 | 50 | 24 |
| 6 | 50 | 26 |
| 7 | 50 | 23 |
| 8 | 50 | 28 |
| 12 | 50 | 29 |
| 13 | 50 | 27 |
| 14 | 50 | 28 |
| 15 | 50 | 24 |
| 16 | 50 | 26 |

COMPARATIVE EXAMPLE 5

Example 1 was repeated, in the absence of Assistant 1, and using instead a polyethyleneimine of molecular weight 1,500 or 860 as the assistant; the dye content in the drainage water was about twice as great as when using the assistants in Table 1. In contrast to the cationic assistants employed according to the invention, the polyetyleneimines show no additional marked improvement in dye retention when employed in larger amounts.

TABLE 2

| Assistant | % of assistant, based on dye employed | % of dye in the drainage water |
|---|---|---|
| Polyethyleneimine, molecular weight 1,500 | 25 | 69 |
| Polyethyleneimine, molecular weight 1,500 | 50 | 40 |
| Polyethyleneimine, molecular weight 1,500 | 100 | 23 |
| Polyethyleneimine, molecular weight 1,500 | 175 | 19 |
| Polyethyleneimine, molecular weight 860 | 25 | 59 |
| Polyethyleneimine, molecular weight 860 | 50 | 30 |
| Polyethyleneimine, molecular weight 860 | 100 | 18 |
| Polyethyleneimine, molecular weight 860 | 175 | 16 |

EXAMPLE 6

Example 1 was repeated except that the assistants shown in Table 3, in the amounts indicated there, were employed. This Example shows that when using the assistants according to the invention, a given color strength of the paper sheet is achieved more rapidly than when using conventional assistants. The color strength of the colored paper was determined from its reflectance curve. The color strength achieved with the assistants according to the invention, at a given concentration, based on fiber material employed, is taken as 100 and is compared with the color strength achieved with the corresponding intermediate (not reacted with benzyl chloride) of the assistant according to the invention.

TABLE 4

| Assistant No. | % of assistant, based on dye | Relative color strength of the paper sheet |
|---|---|---|
| 1 | 50 | 100 |
| Polyethyleneimine, molecular weight 1,500 | 50 | 70 |
| 2 | 50 | 100 |
| Polyethyleneimine, molecular weight 860 | 50 | 60 |
| 3 | 50 | 100 |
| (reaction product of piperazine and epichlorohydrin) | 50 | 65 |

COMPARATIVE EXAMPLE 6

Example 1 was repeated except that in place of Assistant 1 according to the invention, Assistants 9 to 11 were employed, these having been prepared with alkylating agents devoid of aromatic groups. The drainage water from the laboratory sheet-forming apparatus was found to contain substantially more dye than when assistants according to the invention were used. This is clear from a comparison of the results in Table 1 with those of Table 5.

TABLE 5

| Prior art Assistant No. | % of assistant, based on dye employed | % of dye in the drainage water, based on dye employed |
|---|---|---|
| 9 | 50 | 42 |
| 9 | 100 | 26 |
| 10 | 50 | 27 |
| 10 | 100 | 31 |
| 11 | 50 | 44 |
| 11 | 100 | 28 |

EXAMPLE 7

Assistants were prepared as for Assistant 4, but using, in place of 0.6 mole of benzyl chloride per equivalent of nitrogen, (a) 0.1 mole of benzyl chloride per equivalent of nitrogen (Assistant 4*a*)

(b) 0.2 mole of benzyl chloride per equivalent of nitrogen (Assistant 4*b*)

(c) 0.3 mole of benzyl chloride per equivalent of nitrogen (Assistant 4*c*)

and these assistants were tested, in place of Assistant 1, by the method described in Example 1. The following results were obtained.

TABLE 6

| Assistant No. | % of assistant, based on dye employed | % of dye in the drainage water, based on dye employed |
|---|---|---|
| 4a | 100 | 24 |
| 4b | 100 | 15 |
| 4c | 100 | 10 |

We claim:

1. A process for coloring paper with an acid dye or direct dye or mixtures thereof in an aqueous medium in the presence of a cationic assistant, wherein the cationic assistant employed is a water-soluble reaction product of an alkylating agent, possessing an aromatic substituent, with a cationic polyelectrolyte, containing aminoalkyl groups, selected from the group comprising polyethyleneimine,polyvinylamines and reaction products of ammonia or an amine and 1,2-dichloroethane, epichlorohydrin, dichlorohydrin or a chlorohydrin ether of a dihydric or polyhydric alchol, not less than 10% of the aminoalkyl groups of the cationic polyelectrolyte being reacted with the alkylating agent.

2. A process as claimed in claim 1, wherein the cationic assistant used is a water-soluble product obtained by reacting benzyl chloride or styrene oxide with polyethyleneimine, polyvinylamine or a reaction product of ammonia or an amine and 1,2-dichloroethane, epichlorohydrin, dichlorohydrin or a chlorohydrin ether of a dihydric or polyhydric alcohol.

3. A process as claimed in claim 1 or 2, wherein the water-soluble reaction product of an alkylating agent, possessing an aromatic substituent, with the cationic polyelectrolyte is modified, in a second stage, by reaction with cyanamide or dicyandiamide or mixtures thereof.

4. A process as claimed in claim 1, wherein the paper is wet-end colored, ie. before forming the sheet.

5. A process as claimed in claim 1, wherein the paper is colored after forming the sheet.

6. A process as claimed in claim 1, wherein the cationic assistant is employed in an amount of from 10 to 300% by weight based on the dye.

* * * * *